US005495215A

United States Patent [19]

Newell et al.

[11] Patent Number: 5,495,215

[45] Date of Patent: Feb. 27, 1996

[54] COAXIAL RESONATOR FILTER WITH VARIABLE REACTANCE CIRCUITRY FOR ADJUSTING BANDWIDTH

[75] Inventors: Michael Newell, Placitas; Raymond Sokola; David Heine, both of Albuquerque, all of N.M.

[73] Assignee: Motorola, Inc., Schaumburg, Ill.

[21] Appl. No.: 309,284

[22] Filed: Sep. 20, 1994

[51] Int. Cl.[6] ..... H01P 1/20

[52] U.S. Cl. ..... 333/202; 333/206; 333/207; 333/222; 333/223

[58] Field of Search ..... 333/202, 203, 333/206, 207, 235, 222, 223, 175

[56] References Cited

U.S. PATENT DOCUMENTS

| | | | |
|---|---|---|---|
| 4,431,977 | 2/1984 | Sokola et al. | 333/207 |
| 4,799,034 | 1/1989 | Silverman et al. | 333/235 |
| 5,055,808 | 10/1991 | Walker | 333/207 |
| 5,150,089 | 9/1992 | Komazaki et al. | 333/207 |
| 5,157,365 | 10/1992 | Hoang | 333/207 |
| 5,170,141 | 12/1992 | Yamazaki et al. | 333/207 |
| 5,227,747 | 7/1993 | Komazaki et al. | 333/207 |
| 5,227,748 | 7/1993 | Sroka | 333/207 |
| 5,239,280 | 8/1993 | Noguchi et al. | 333/202 |
| 5,327,109 | 7/1994 | Hoang et al. | 333/202 |
| 5,392,011 | 2/1995 | Li | 333/173 |

*Primary Examiner*—Benny Lee
*Assistant Examiner*—Darius Gambino
*Attorney, Agent, or Firm*—Gary J. Cunningham

[57] ABSTRACT

A filter (102) with an adjustable bandwidth. The filter (102) has a predetermined passband and stopband, and an input (104), an output (106) and at least two resonator structures (116, 124), and a variable reactance element (108) for adjusting the bandwidth of the passband, coupled between the resonator structures (116, 124), whereby the frequency response is adjustable.

14 Claims, 1 Drawing Sheet

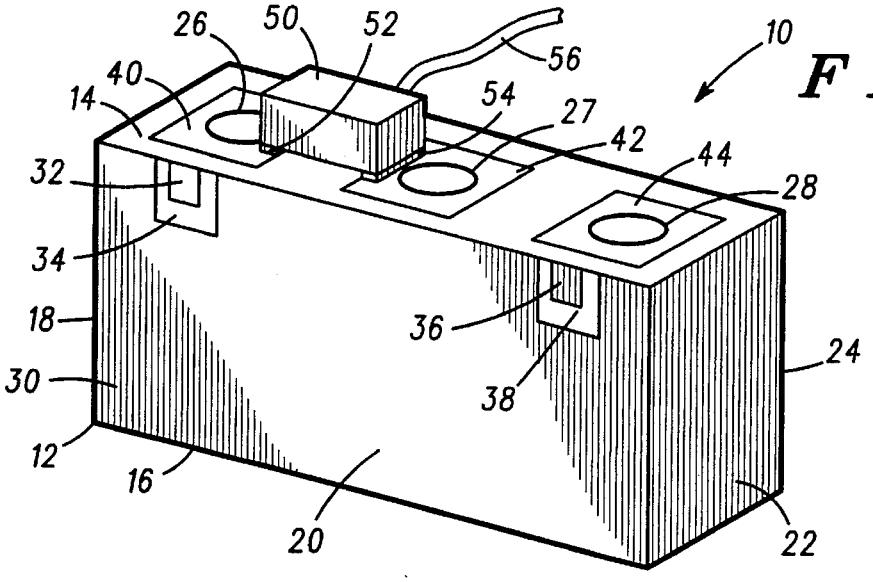
FIG.1
FIG.2
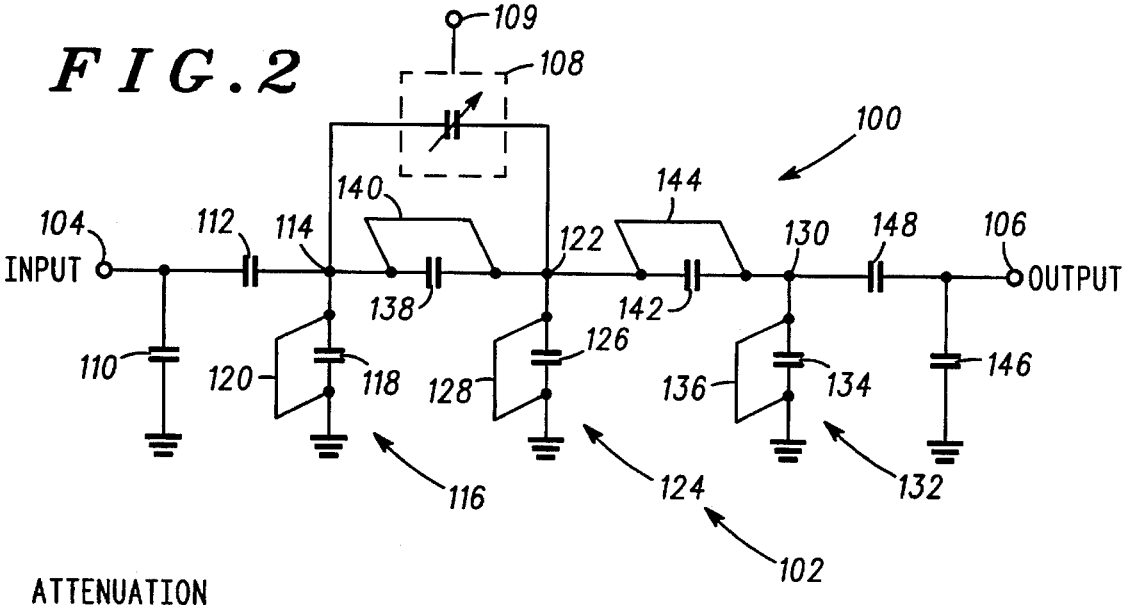
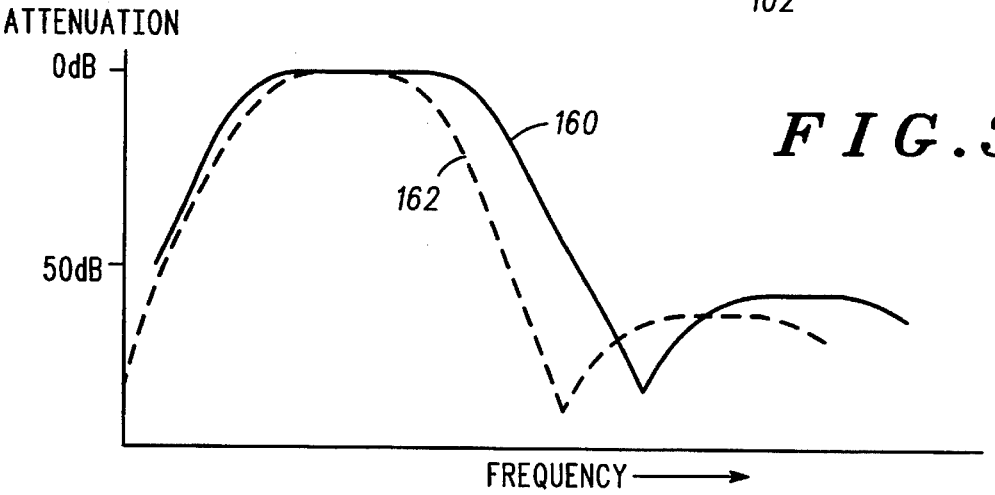
FIG.3

COAXIAL RESONATOR FILTER WITH VARIABLE REACTANCE CIRCUITRY FOR ADJUSTING BANDWIDTH

FIELD OF THE INVENTION

This invention generally relates to filters, and in particular, to a filter with an adjustable bandwidth.

BACKGROUND OF THE INVENTION

Filters are known to provide attenuation of signals having frequencies outside of a particular frequency range and little attenuation to signals having frequencies within the particular frequency range of interest. As is also known, these filters may be fabricated from ceramic materials having one or more resonators formed therein. A ceramic filter may be constructed to provide a lowpass filter, bandpass filter or a highpass filter, for example.

For bandpass filters, the bandpass area is centered at a particular frequency and has a relatively narrow bandpass region, where little attenuation is applied to the signals. While this type of bandpass filter may work well in some applications, it may not work well when a wider bandpass region is needed or special circumstances or characteristics are required.

Ceramic block filters typically use an electrode pattern on a top surface of an ungrounded end of a combline design. This pattern serves to load and shorten resonators of a combline filter. The pattern helps define coupling between resonators, and can define frequencies of transmission zeros.

These top metallization patterns are typically screen printed on the ceramic block. Many block filters include chamfered resonator through-hole designs to facilitate this process by having the loading and coupling capacitances defined within the block itself, for manufacturing purposes. The top chamfers help define the intercell couplings and likewise define the location of the transmission zero in the filter response. This type of design typically gives a response with a low side zero.

To achieve a high side transmission zero response, chamfered through-holes are placed at the grounded end (bottom) of ceramic block filters, for example. Thus, a high zero response ceramic filter can have chamfers at both ends of the dielectric block. A double chamfer filter can be difficult to manufacture because of the tooling requirements and precise tolerances.

A bandwidth of a filter can be designed for specific passband requirements. Typically, the tighter the passband, the higher the insertion loss, which is an important electrical parameter. However, a wider bandwidth reduces the filter's ability to attenuate unwanted frequencies, typically referred to as the rejection frequencies.

A filter which can be easily manufactured to manipulate and adjust the frequency response (preferably with an adjustable bandwidth, for attenuating unwanted signals, for example), could improve the performance of a filter and would be considered an improvement in filters, and particularly ceramic filters.

Having the ability to adjust the bandwidth of a filter, could effectively improve the performance of a filter, and would allow a user to adjust the filter as desired.

A mass-producable, dynamically tunable (or adjustable) filter which can modify the frequency response by attenuating unwanted signals, could improve the desired performance of a filter, and would be considered an improvement in filters.

BRIEF DESCRIPTION OF THE DRAWINGS

FIG. 1 is an enlarged, perspective view of a filter with an adjustable bandwidth, in accordance with the present invention.

FIG. 2 is an equivalent circuit diagram of the filter shown in FIG. 1, in accordance with the present invention.

FIG. 3 shows two exemplary, adjustable frequency responses of the filter shown in FIGS. 1 and 2, in accordance with the present invention.

DETAILED DESCRIPTION OF THE PREFERRED EMBODIMENT

In FIGS. 1 and 2, a filter 10 with an adjustable bandwidth is shown. The frequency response of this filter can be dynamically adjusted, as is shown in FIG. 3. More particularly, FIG. 3 shows a passband for passing a desired frequency, which is dynamically adjustable, to narrow or widen the passband, as desired.

In more detail, the filter 10 can include a ceramic filter 12 comprising a parallelpiped shaped block of dielectric material, and further including a top 14, bottom 16, left side 18, front side 20, right side 22, and rear side 24. The ceramic filter 12 has a plurality of through-holes extending from the top to the bottom surfaces 14 to 16, defining resonators. The through-holes include a first, second and third through-hole 26, 27 and 28, respectively, each of which is substantially coated with a conductive material, and each is connected to the metallization on the bottom 16. The surfaces 16, 18, 20, 22, and 24, are substantially covered with a conductive material defining a metallized exterior layer 30, with the exception that the top surface 14 is substantially uncoated comprising the dielectric material. Additionally, a portion of the front side 20 is substantially uncoated comprising the dielectric material, defining uncoated areas 34 and 38, surrounding input-output pads 32 and 36, respectively.

On the top surface 14, first, second and third metallization patterns 40, 42 and 44, are connected to the metallization in the first, second and third through-holes 26, 27 and 28, respectively, to provide capacitive loading of quarter-wave resonators formed by the through-holes and the metallization. A variable reactance element 50 is shown in FIG. 1, mounted on the top surface 14 of the ceramic filter 12, and includes a first connection 52 connected to the first metallized pattern 40 and first through-hole 26, a second connection 54 connected to the second metallized pattern 42 and through-hole 27, and a control signal input 56, for controlling the variable reactance element 50.

The filter 10 includes a variable reactance element 50, which in a preferred embodiment, is a variable voltage capacitor, which can be used to dynamically adjust the bandwidth. By modifying the coupling between the resonators, the bandwidth, insertion loss and rejection of a bandpass filter can be altered to achieve the desired performance. An adjustable reactance element can be used to obtain a filter which is dynamically adjustable. Thus, the characteristics of the device containing the dynamically adjustable filter can be optimized for specific applications or environments. A second major advantage of a filter such as that disclosed herein, is that with the variable reactance element, the coupling can be adjustable such that the impedance presented at the input or output ports (pads) 32 and 36 can be dynamically adjusted. This can be used to optimize the power transfer between the filter and the devices to which it is connected, resulting in an overall reduction in power loss.

The coupling between adjacent resonators in coupled resonator filters, controls the bandwidth of the filter to a large extent. The coupling in a multi-cavity ceramic block is generally electromagnetic in nature, and consists of both inductive and capacitive components. Additional inductive or capacitive coupling can be obtained through the use of variations in the metallized top pattern in the region between adjacent resonators, as is known in the field, or with other components such as inductors, capacitors, etc. The instant invention allows a filter to be optimized for specific applications, and can also provide a decrease in power loss.

An equivalent circuit diagram of the filter 10 is shown in FIG. 2 as item 100. The circuit 100 includes a bandpass filter 102 which includes an input node 104 and an output node 106 and at least two resonator structures, and a variable reactance element (VVC) 108 for adjusting the bandwidth of the passband, connected between the resonator structures, whereby the frequency response is adjustable. In a preferred embodiment, the filter 102 has a predetermined passband and stopband, which is dynamically adjustable and is substantially as shown in FIG. 3.

Having the ability to dynamically adjust the bandwidth of a filter, is particularly advantageous in cellular telephones and telecommunications equipment. For example, when used in densely populated areas where there may be many similar telephones and a relatively small geographic area, it may be necessary or desirable, for optimal transmission quality, to narrow the filter passband and increase the rejection of other signals close in frequency. When used in more sparsely populated areas, it may be appropriate for the rejection to be relaxed to gain lower passband insertion loss so that weaker signals from more distant transmitters, can be received.

Another benefit of filter 10, is that impedance matching between a power amplifier and a filter can be achieved, with the variable reactance element 50. The output impedance of the power amplifier and the input impedance of the filter both are functions of frequency. When the two impedances are not the same, some power can be lost due to the impedance mismatch. In a cellular telephone application for example, more battery power is consumed due to this mismatch loss, which can shorten the life of a battery. A filter whose input impedance can be altered dynamically, could be optimized as needed, as the frequency is changed so that maximum power transfer is achieved. This could result in longer battery life.

In more detail, the variable reactance element 108 includes a control signal input 109, for varying the reactance of the variable reactance element 108.

The variable reactance element 108 can vary widely. In a preferred embodiment, the variable reactance element comprises a voltage variable capacitor (VVC) because it has several desirable characteristics, such as a high quality factor or "Q", wide capacitance range, narrow control voltage range and small size. Similarly, a varactor or other known variable reactance elements can be used, if desired.

Connected between the input node 104 and ground is a first input capacitor 110. A second input capacitor 112 is coupled between the input node 104 and first resonator node 114. A first resonator 116 is shown coupled between the first resonator node 114 and ground, and includes in parallel, capacitive and inductive elements 118 and 120, respectively.

Similarly, second and third resonator nodes 122 and 130 are shown in FIG. 2. A second resonator 124 is shown being coupled between the second resonator node 122 and ground, and includes a capacitive element 126 and an inductive element 128. And likewise, a third resonator 132 includes a capacitive element 134 and an inductive element 136, coupled in parallel between the third resonator node 130 and ground.

Also shown in FIG. 2, connected in parallel between the first and the second resonator nodes 114 and 122, are capacitive and inductive elements 138 and 140. Similarly, between the second and the third resonator nodes 122 and 130, are capacitive and inductive elements 142 and 144 in parallel. The inductive elements 140 and 144, represent the electro-magnetic coupling between resonators 116 and 124, and 124 and 132, respectively, which exists due to the close proximity of the through-holes 26 and 27, and 27 and 28, respectively. Capacitive elements 138 and 142 represent the capacitances formed between the metallized patterns 40 and 42, and 42 and 44, respectively.

A first output capacitor 146 is coupled between the output node 106 and ground and a second capacitor 148 is connected between the output node 106 and the third resonator node 130.

The capacitor 146 is defined as the capacitance between the output (second) pad 36 and the metallized layer 30 on the front side 20, in FIG. 1. The capacitor 148 is defined as the capacitance between the output pad 36 and the third metallized pattern 44.

Referring to FIG. 2, connected between the first node 114 and second node 122 is a parallel resonant circuit defined by the capacitive element 138 and inductive element 140, in parallel. The variable reactance element 108 with the control signal input 109, provides a variable capacitance across the parallel resonant circuit between nodes 114 and 122. The variable reactance element 108 can provide a dynamically adjustable (variable) frequency response, substantially as shown in FIG. 3. For example, a typical response of a bandpass filter could look like the first frequency response 160. In the event that the control signal input 109 is suitably adjusted, to increase the capacitance of the variable reactance element 108, a new response, such as that shown in dashed line (or second frequency response) 162, can be provided. In conventional VVC's, the capacitance usually increases as the central voltage is increased. However, if one decreases the capacitance, the dashed line 162 could be adjusted and moved to provide a wider bandwidth (which is, for example wider than the frequency response 160). Conversely, when the control voltage is high (or has a logic one), the VVC capacitance increases, resulting in a narrower bandwidth.

The ability to dynamically adjust the bandwidth and shunt zero, as shown in the figures, can result in substantial weight savings and size minimization, by allowing the use of a physically smaller filter. Additionally, it can be advantageous to be able to dynamically adjust the bandwidth in many applications. A non-adjustable filter which has both wider bandwidth and increased rejection, with similar insertion losses to the filter 10 described herein, would have to be physically larger to decrease the loss (or increase the "Q") with more cavities or resonators to increase the rejection. Advantageously, the instant invention is adjustable to accommodate many applications and address varying requirements.

In an alternate embodiment, the variable reactance element 108 can be coupled between the second and third nodes 122 and 130, to attain a frequency response similar to that shown in FIG. 3. Placing the VVC between the second and third resonators 124 and 132 would provide the same advantages as the placement shown in FIG. 1. Similarly, if more than three resonators were used, placement could be adjusted similarly, if desired.

Alternatively, a first variable reactance element 108 can be connected between nodes 114 and 122, and a second variable reactance element (not shown in the figures), can be connected between nodes 122 and 130. This could result in a wider dynamic range and improved impedance matching.

In any event, a preferred embodiment is as shown in FIGS. 1 and 2, for improved performance and simplicity in design.

The variable reactance element 108 can vary widely. For example, the variable reactance element 108 can include a varactor, a variable voltage capacitor and the like. In a preferred embodiment, the variable reactance element 108 includes a variable voltage capacitor for its high quality factor ("Q"), small size, large capacitance range and small input signal requirements. A preferred VVC includes a three terminal semiconductor device which exhibits capacitance ranges between a minimum and a maximum value between two of its terminals. The value is a function of the voltage applied to the third terminal, or input terminal 56.

In one embodiment, the filter 10 comprises a ceramic filter 12 having a predetermined passband and stop band, including an input, an output and at least three resonator structures, and a variable reactance element, connected between at least two of the resonator structures, whereby the frequency response of the filter is adjustable.

The number of resonator structures can vary widely depending on the application. A three resonator structure as shown in FIGS. 1 and 2 is a preferred embodiment, for its compact size, desired frequency response and performance, low loss with moderate signal rejection, and the ability of being mass produced.

In more detail, the first, second and third resonator structures 116, 124 and 132, comprise capacitively and inductively loaded transmission lines operating at predetermined resonant frequencies, and the variable reactance element comprises at least one of a first variable reactance element and a second variable reactance element between the resonator structures 116 and 124, and 124 and 132.

The addition of more than one adjustable reactance device can result in a device or filter with a slightly wider tuning range and one which can be more closely matched in impedance, to the devices connected to the input and the output of the filter.

The variable reactance element 108 includes a sufficient adjustment to adjust at least the bandwidth and the transmission zero of the desired frequency response. In more detail, the variable reactance element 108 includes a transmission zero which is sufficiently adjustable such that certain signals can be attenuated. The variable reactance element 108 can be adjusted to substantially minimize receiver performance degradation, and alternatively, to substantially minimize leakage of certain outgoing signals in a transmitter, for example.

The filter 10 is particularly adapted for use in connection with a receiver, transmitter or the like.

The instant invention is particularly adapted for use as a transmit filter in domestic (AMPS) cellular phones. In this application, the wider passband would have a three dB bandwidth of approximately 35 MHz centered at about 836.5 MHz. The attenuation for signals in the range of 869–885 MHz would have a minimum of about 35 dB, and attenuation for signals between 885–894 MHz would have a minimum of about 45 dB. The passband insertion loss between 824–849 MHz would be approximately ~1.5 dB. In the wide passband mode, the insertion loss is low so as to minimize battery drain. This mode would be used when the phone is using a higher channel.

When the phone is being utilized in one of the lower channels, the control voltage on the variable reactance device would be increased and the passband would be narrowed to approximately 15–20 MHz, with an insertion loss near to 2–2.5 dB. The attenuation for signals between 869–885 MHz would be about 45 dB. This mode would require more battery power because of the increased insertion loss. A filter such as this, could be built smaller than currently used subscriber filters, while providing similar or improved performance.

Although the present invention has been described with reference to certain preferred embodiments, numerous modifications and variations can be made by those skilled in the art without departing from the novel spirit and scope of this invention.

What is claimed is:

1. A filter with an adjustable bandwidth, comprising:

a filter having a predetermined passband and stopband, including an input, an output and at least two resonator structures;

a variable reactance element for adjusting the bandwidth of the passband comprising a variable voltage capacitor, coupled between the resonator structures defining a first and a second node;

the variable voltage capacitor includes a control signal input whereby the frequency response is adjustable; and the control signal input includes a plurality of possible control voltages to provide a substantially continuous adjustment of the capacitance of the variable voltage capacitor over it's tuning range, including at least a low voltage signal in proximity to a logic zero, a high voltage signal in proximity to a logic one and an intermediate signal therebetween;

the low voltage signal provides adjustment to lower the capacitance between the first and second nodes to provide a fine-tune adjustment defining a wider bandwidth;

the high voltage signal provides adjustment to raise the capacitance between the first and second nodes to provide a fine-tune adjustment defining a narrower bandwidth; and the intermediate voltage signal provides adjustment to define an intermediate bandwidth between the wider and narrower bandwidth.

2. The filter of claim 1, wherein the variable reactance element comprises a variable voltage capacitor or varactor.

3. The filter of claim 1, wherein the first resonator structure is defined as a capacitively loaded transmission line operating at a predetermined resonating frequency, the second resonator structure also being defined as a capacitively loaded transmission line operating at a predetermined resonating frequency, and the variable reactance element being connected between the first and the second resonator structures.

4. The filter of claim 3, wherein the first and the second resonator structures include a predetermined inductive and capacitive coupling, the predetermined inductive and capacitive coupling and the variable reactance element are connected in parallel.

5. The filter of claim 1, wherein the variable reactance element includes sufficient adjustment to adjust at least one of the bandwidth and the transmission zero of the frequency response of the filter.

6. A filter with an adjustable bandwidth, comprising:

a filter having a predetermined passband and stopband, including an input, an output and at least three resonator structures defined by three through-holes;

a variable reactance element comprising a variable voltage capacitor, connected between at least two of the resonator structures defining a first node and a second node, whereby the frequency response of the filter is adjustable;

the control signal input includes a plurality of possible control voltages to provide a substantially continuous adjustment of the capacitance of the variable voltage capacitor over it's tuning range, including at least a low voltage signal in proximity to a logic zero, a high voltage signal in proximity to a logic one and an intermediate signal therebetween;

the low voltage signal provides adjustment to lower the capacitance between the first and second nodes to provide a fine-tune adjustment defining a wider bandwidth;

the high voltage signal provides adjustment to raise the capacitance between the first and second nodes to provide a fine-tune adjustment defining a narrower bandwidth; and the intermediate voltage signal provides adjustment to define an intermediate bandwidth between the wider and narrower bandwidth.

7. The filter of claim 6, wherein the variable reactance element is a variable voltage capacitor or a varactor.

8. The filter of claim 6, wherein first, second and third resonator structures comprise capacitively loaded transmission lines operating at predetermined resonant frequencies, and the variable reactance element comprises a first variable reactance element and a second variable reactance element coupled between the resonator structures.

9. The filter of claim 6, wherein the variable reactance element is connected between one or more of the resonator structures.

10. The filter of claim 6, wherein the variable reactance element includes sufficient adjustment to adjust at least one of the bandwidth and the transmission zero of the frequency response of the filter.

11. The filter of claim 10, wherein the transmission zero is adjustable such that undesirable signals are attenuated.

12. The filter of claim 11, wherein the variable reactance element is connected to a receiver to adjustably, substantially minimize receiver performance degradation.

13. The filter of claim 11, wherein the variable reactance element is connected to a transmitter to adjustably, substantially minimize leakage of certain outgoing signals.

14. The filter of claim 6, wherein the filter is connected to at least one of a receiver and transmitter.

* * * * *